United States Patent [19]

Saiki et al.

[11] 4,297,793

[45] Nov. 3, 1981

[54] APPARATUS FOR SUPPLYING MATERIALS TO BELT TYPE CONTINUOUS VACUUM DRYER

[75] Inventors: Yukihiro Saiki, Saitama; Eitaro Kumazawa, Sayama; Yozo Ishioka, Higashikurume, all of Japan

[73] Assignee: Snow Brand Milk Products Co., Ltd., Sapporo, Japan

[21] Appl. No.: 120,950

[22] Filed: Feb. 13, 1980

[51] Int. Cl.[3] ..... F26B 15/18

[52] U.S. Cl. ..... 34/56; 34/92; 222/312; 222/553

[58] Field of Search ..... 222/415, 412, 317, 312, 222/311, 310, 553; 34/92, 236, 56

[56] References Cited

U.S. PATENT DOCUMENTS

| | | | |
|---|---|---|---|
| 3,182,867 | 5/1965 | Barosko et al. | 222/553 |
| 3,240,401 | 3/1966 | Kirschmann | 222/311 |
| 3,415,424 | 12/1968 | Crossley | 222/311 |
| 3,864,840 | 2/1975 | Baskin | 34/92 |

*Primary Examiner*—Larry I. Schwartz
*Attorney, Agent, or Firm*—Blanchard, Flynn, Thiel, Boutell & Tanis

[57] ABSTRACT

An improved apparatus for supplying materials, useful for belt type continuous vacuum dryer, is provided which comprises an inner cylinder equipped with a material-supplying duct fixed onto one end thereof, a distributing chamber formed inside the cylinder and communicating with the duct and a plurality of distributing nozzles fixed thereto; an outer cylinder having the inner cylinder rotatably inserted thereinto and having a plurality of distributing nozzles provided at the opposed locations to the former distributing nozzles; a screw feeder provided in freely rotatable manner inside the distributing chamber; and a driving mechanism for rotating the outer cylinder.

According to this apparatus, it is possible to supply materials on a moving belt, continuously and uniformly over the whole surface of the belt.

5 Claims, 9 Drawing Figures

APPARATUS FOR SUPPLYING MATERIALS TO BELT TYPE CONTINUOUS VACUUM DRYER

BACKGROUND OF THE INVENTION

1. Field of the Invention

This invention relates to an apparatus for supplying materials, employed when materials, particularly those having high heat sensitivity material such as foods, chemicals, etc., are supplied onto a belt continuously moving inside a vacuum dryer and dried.

2. Description of the Prior Art

In order to prevent materials as mentioned above from denaturation by heat, it has been thought of to lower the vaporization temperature of the water contained therein, and thus a vacuum drying process has been employed.

Such a process has been usually carried out by passing a belt through a vacuum dryer. A degree of vacuum in the range of 1 to 100 Torr has been employed although it varies depending on the materials.

As what is to be particularly stressed in this case, the state of the materials distributed on the belt is mentioned. Namely, materials should be supplied onto the belt continuously, in a definite amount and in a uniform thickness. If this supplying state fluctuates, the balance between the materials and the heat quantity supplied is destroyed, resulting in heat denaturation of the materials or inferior dried products having an uneven water content.

Accordingly, in order to continuously obtain dried products of good quality under optimal conditions and in a short time, it is necessary to supply materials under optimal conditions depending on the physical properties of the materials. Thus it has been desired to provide an apparatus for supplying materials which makes it possible to realize supplying conditions depending on the respective physical properties of different materials and yet makes easy the operation or control therefor.

Now, as for apparatuses currently employed as those of such a kind, apparatuses as shown in FIG. 1, FIG. 2 and FIG. 3 of the accompanying drawings may be illustrated.

The apparatus shown in FIG. 1 is referred to generally as the slit type supplying apparatus, wherein a supplying apparatus 1 is provided above a belt 3 tensioned on a roller 2 which, in turn, is provided inside a vacuum drying chamber (not shown).

In this supplying apparatus 1 a material "a" is supplied through ducts provided outside the drying chamber and equipped with a stop valve 5 and flow control valves 4, to a distributing chamber 6, by means of a metering pump (not shown), and is distributed onto the belt 3 through a distributing nozzle 7 provided in front of and at the lower end of the distributing chamber. In addition, a cooling chamber 10 is provided adjacent to the distributing chamber 6, and cooling water is introduced into the cooling chamber through an inlet tube 8 and discharged therefrom through an outlet tube 9.

The apparatus shown in FIG. 2 is referred to generally as a pipe type supplying apparatus 1 wherein a material "a" is distributed onto a belt 1 through ducts equipped with a stop valve 5 and control valves 4 in the same manner as in FIG. 1, and further through a plurality of supply tubes 11 arranged in parallel to the moving direction of the belt and on the same level as that of the belt surface.

The apparatus shown in FIG. 3 is referred to generally as an orifice type supplying apparatus 1, wherein a material "a" is supplied into a plurality of distributing chambers 14 provided above a belt (not shown), through ducts equipped with a stop valve 5 and control valves 4 in the same manner as in FIG. 1 and FIG. 2, and further supplied onto the belt through distributing nozzles 13 bored in a bottom plate 12.

However, each of the above-mentioned conventional apparatuses has the following drawbacks:

(1) In the apparatuses of FIG. 1, FIG. 2 and FIG. 3, the control of the amount supplied and the stopping of the supply may be carried out at the outlet of nozzle 7 (FIG. 1), nozzle 13 (FIG. 3) or supply tubes 11 (FIG. 2), but this requires a complicated mechanism; hence they have been employed operating valves 4 and stop valve 5 provided outside the drying chamber.

However, between the control valves 4 and stop valve 5 and the outlet 7, 11 or 13, are located ducts, the distributing chamber, etc., and due to the effect of the preceding material present therein, a time-lag occurs between the time of operation of the control valves 4 and stop valve 5 and the time at which the material leaving the outlet 7, 13 or 11 is actually controlled in amount or stopped. As for this time-lag, the higher the concentration or the viscous property of the material, the longer is the time-lag, which makes difficult the correct control or stopping.

(2) Further, in the apparatuses of FIG. 1, FIG. 2 and FIG. 3, as for the material present between the control valves 4 and the stop valve 5 and the outlet 7, 11 or 13, even when the control valves 4 and the stop valve 5 are closed at the time of stopping the material supply, the material flows out of the outlet onto the belt, little by little over a long time, under the influence of the negative pressure inside the drying chamber. The material which has flowed out becomes an excessively dried product and mixes in the normally dried product to reduce the quality of the product. Thus, in order to prevent this, even if the belt motion is stopped at the same time as the stopping of the material supply, the flowing-out of the material onto the belt cannot be prevented, and removal of this material which has flowed out and a washing operation therefor become necessary.

(3) Particularly in the apparatus of FIG. 1, when the nozzle 7 has a uniform width, the velocity of the material "a" on the belt 3 is distributed so that the velocity may be higher at the central portion thereof and lower on both the sides thereof, as shown in FIG. 4A.

Such a difference in the velocity distribution results, as it is, in a difference in the amount of the material distributed on the belt. Thus, in order to make the distribution uniform, it has been attempted, for example, to provide a core which constitutes a body resistant to flow, in front of a nearly central portion of the nozzle 7. As a result, the velocity distribution is improved as shown in FIG. 4B. However, the shape, location, etc. of such a core must be adequately selected depending on the physical properties of the material, hence such an operation is very difficult.

Thus, as a method for avoiding such a difficulty, increase in the number of ducts to the distributing chamber 6, variance in the aperture width of the nozzle, or the like means may be thought of, but the design or manufacture of such a means is also difficult.

(4) For the above-mentioned reasons, it has been impossible for any of conventional apparatuses to carry out an increase or decrease in the supply amount and stop the supply in a short time and correctly, and hence it has been very difficult for them to yield a material having a moisture content in a definite amount and continuously.

SUMMARY OF THE INVENTION

Thus, a main object of this invention is to provide an apparatus for supplying materials, which overcomes the abovementioned drawbacks of conventional apparatuses for supplying materials and is capable of yielding a product having a moisture content in a definite amount and continuously, with various kinds of materials.

Another object of this invention is to provide an apparatus for supplying materials, which comprises an inner cylinder equipped with a material-supplying duct fixed onto one end thereof, a distributing chamber formed inside said inner cylinder and communicating with said duct and a plurality of distributing nozzles fixed thereto;

an outer cylinder having said inner cylinder rotatably inserted thereinto and having a plurality of distributing nozzles provided at the corresponding positions to the former distributing nozzles;

a screw feeder provided in freely rotatable manner inside said distributing chamber of said inner cylinder; and a driving mechanism for rotating said outer cylinder, whereby it is possible to equalize the linear velocities of the supplied material in the respective distributing nozzles even when the diameters of the distributing nozzles are the same; to equalize the respective amounts of the material supplied onto a belt moving below said outer cylinder; and to make its thickness practically uniform over the total surface of the belt.

A further object of this invention is to provide an apparatus for supplying materials, wherein said inner cylinder, said distributing nozzles provided in the inner cylinder, said outer cylinder and said distributing nozzles provided in the outer cylinder are constructed so that said outer cylinder is rotated relative to said inner cylinder to displace said distributing nozzles of said outer cylinder relative to those of said inner cylinder and thereby adjust the opening degree of the distributing nozzles to adjust the amount of the material supplied and to stop its supply, whereby the adjusting operation of increasing or decreasing the amount of the material supplied or stopping its supply is immediately achieved by a simple operation of rotating said outer cylinder as a single member, provided with both the functions of the control valves and the stop valve, and hence there is no time-lag between the former operation and the latter one, and further, leakage of the material from the distributing nozzles after stopping its supply can be prevented with certainty to thereby cause no deposit of leaked material on the belt and hence avoid contamination of the belt due to the deposit.

A further object of this invention is to provide an apparatus for supplying materials, wherein said screw feeder is driven by a variable speed motor, the number of revolutions of the feeder being increased in case where the material has a low viscosity, and the number being decreased in case where the material has a high viscosity, to thereby make it possible to supply the material onto the belt at an optimal linear velocity for the material.

A further object of this invention is to provide an apparatus for supplying materials, wherein a toothed ring is fixed onto the outer periphery of said outer cylinder and a pinion is engaged with the ring, whereby it is possible to rotate said outer cylinder simply and certainly by the rotation of the pinion.

DETAILED DESCRIPTION OF PREFERRED EMBODIMENTS

Figure 1:
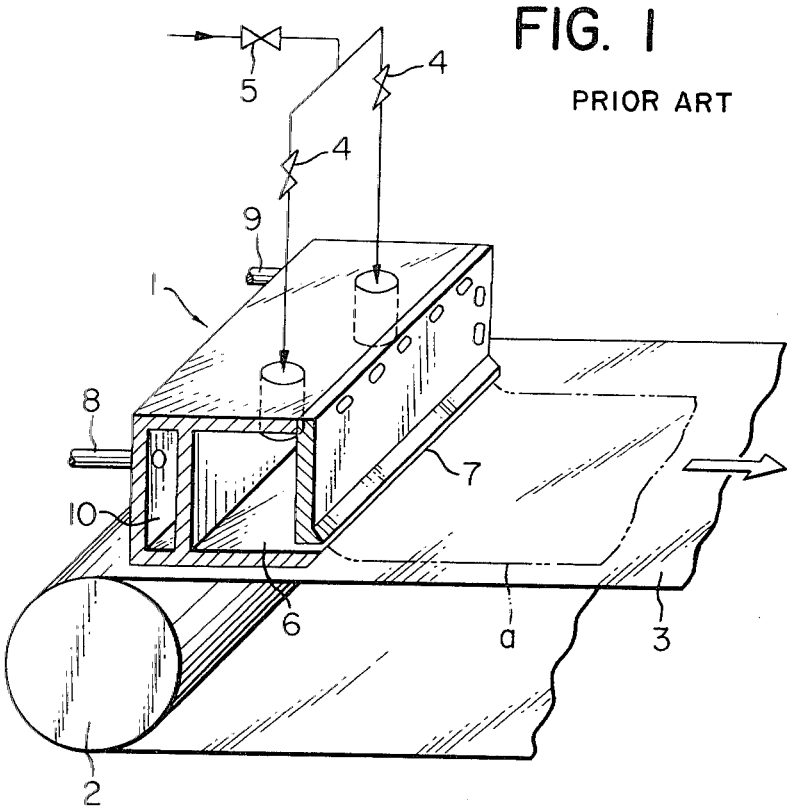
FIG. 1 PRIOR ART
FIG. 1 shows an oblique perspective partly cut away, of a conventional slit type apparatus for supplying materials.
Figure 2:
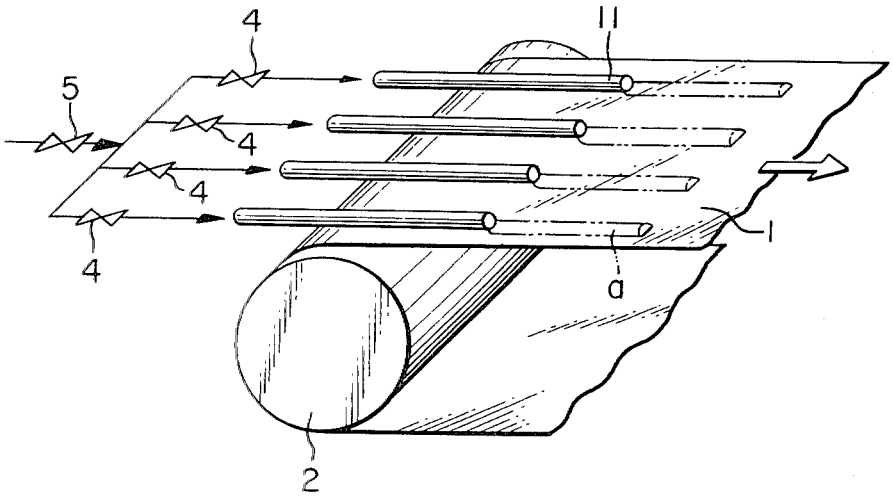
FIG. 2 PRIOR ART
FIG. 2 shows an oblique perspective of a conventional pipe type apparatus for supplying materials.
Figure 3:
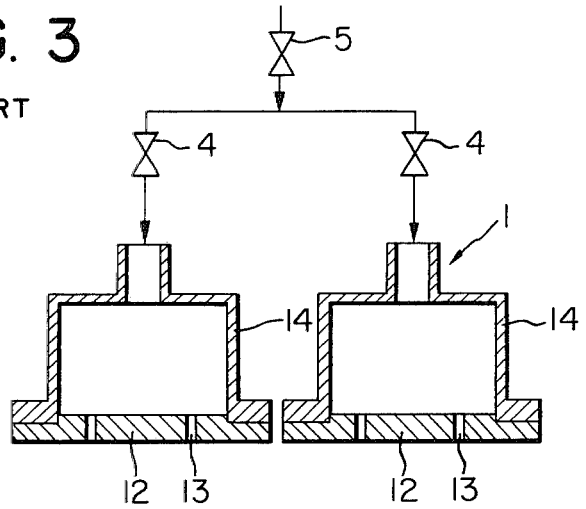
FIG. 3 PRIOR ART
FIG. 3 shows a front view partly cut away, of a conventional orifice type apparatus for supplying materials.
Figure 4:
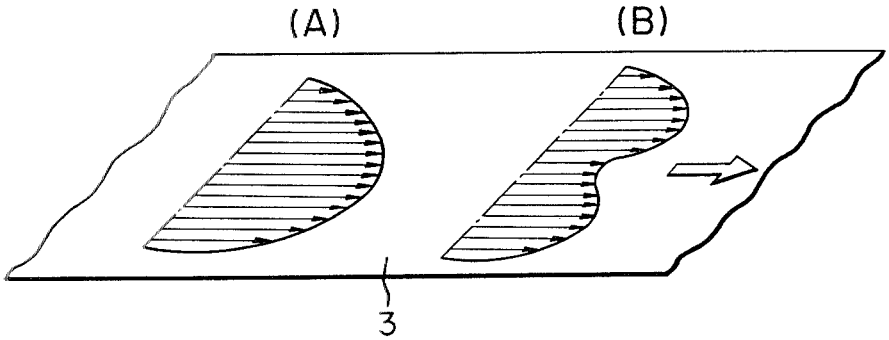
FIG. 4 shows a view of velocity distribution of material supplied according to the apparatus for supplying materials, shown in FIG. 1.
Figure 5:
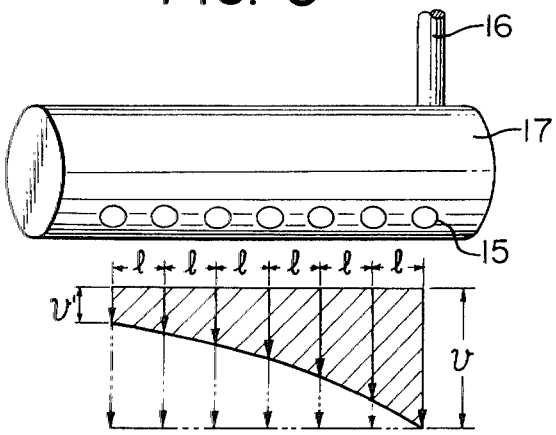
FIGS. 5 and 6 show views of velocity distribution for illustrating the actuation principle of the apparatus of the present invention.

In advance of completion of the above-mentioned invention, the present inventors have made studies on an apparatus is shown in FIG. 5, wherein a plurality of nozzles 15 each having the same diameter are bored in a cylinder 17 at equal intervals of "1", and a material is supplied into the cylinder 17 through a duct 16 provided at one end thereof.

In the case of such an apparatus, since the flow resistances from the duct 16 to the other end of the cylinder vary, the linear velocity "v" of the material in a nozzle 15 closest to the duct 16 is highest, while the linear velocity "v'" in a nozzle at the opposite end is lowest, and the velocities gradually decrease from the velocity "v" to that "v'", as shown by a solid line in FIG. 5.

Figure 6:
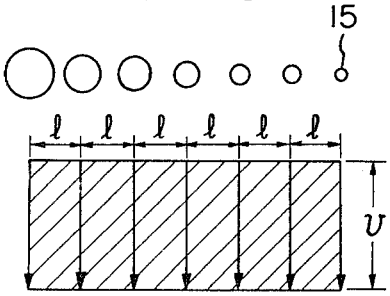

In such an apparatus, if it is intended to equalize the linear velocities in the respective nozzles 15, it is necessary to gradually increase the diameters of the nozzles from adjacent the duct 16 to the opposite end as shown in FIG. 6, which results in a drawback that the design and manufacture thereof are very difficult.

Figure 7:
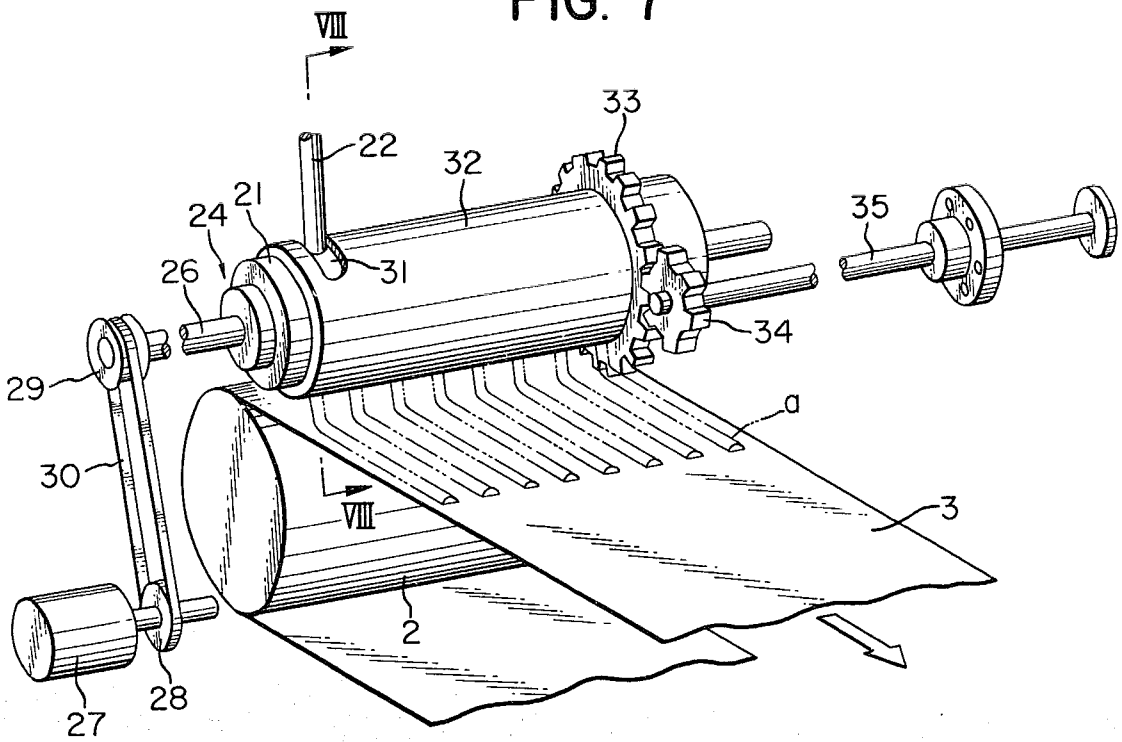
FIG. 7 shows an oblique perspective of the apparatus for supplying materials, of the present invention.
Figure 8:
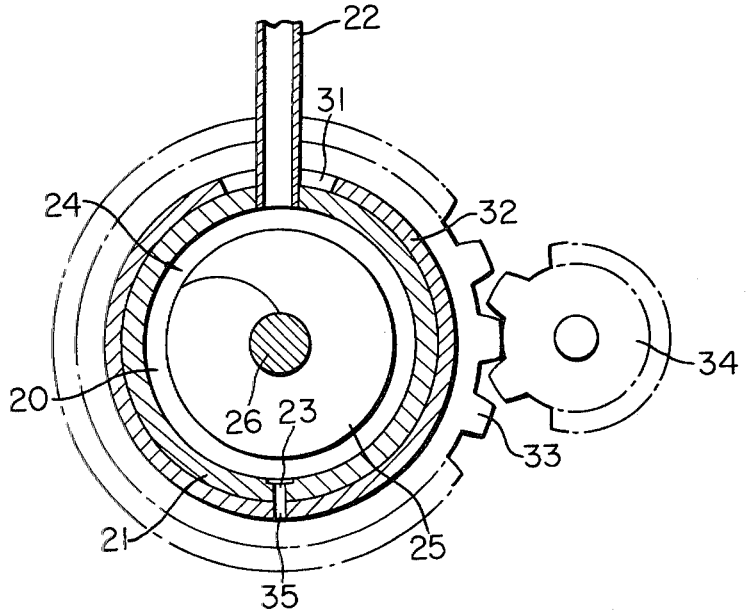
FIG. 8 shows an enlarged cross-sectional view of the apparatus of FIG. 7 cut along the line VIII—VIII.
Figure 9:
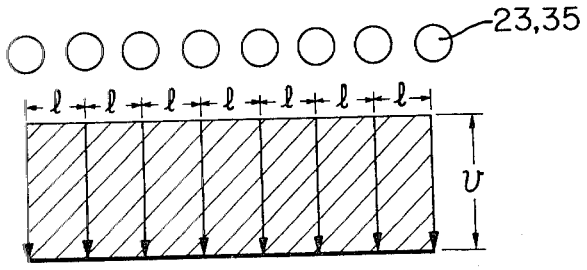
FIG. 9 shows a view of velocity distribution of material supplied according to the apparatus for supplying materials, of the present invention.

Thus, the present inventors have further made studies for obtaining an apparatus for supplying materials, which affords such a velocity distribution as shown in FIG. 9 with such a cylinder as shown in FIG. 5. As a result, an apparatus as an embodiment as shown in FIGS. 7 and 8 has been obtained. The present invention will be hereinafter described referring to this embodiment.

An inner cylinder 21 is fixed above and across a belt 3 by a frame (not shown) in a vacuum drying chamber. The cylinder 21 has a material-supplying duct 22 connected to one end thereof and communicating with a distributing chamber 20 inside the cylinder. Further, the cylinder 21 has at its lower part, a plurality of distributing nozzles 23 bored at an equal interval of "1" and each having the same diameter, through which the distributing chamber 20 communicates with the outside of the cylinder.

The distributing chamber 20 at one side contains a screw feeder 24 whose screw 25 is twisted so that a material supplied to the inside of the distributing chamber 20 through the duct 22 can be carried to the other end of the chamber. The shaft 26 of the screw feeder is rotatably borne by a frame (also not shown), and rotated by a variable speed motor 27 by the medium of pulleys 28 and 29 and a belt 30.

An outer cylinder 32 has the inner cylinder 21 inserted thereinto in a freely rotatable manner and also has a slit 31 provided so that rotation of the outer cylinder 32 will not be obstructed by the duct 22. At the lower part of the outer cylinder 32 are bored distributing nozzles 35 at the corresponding locations to the distributing nozzles 23 of the cylinder 21, and further, onto the outer periphery of the outer cylinder 32 is fixed a toothed ring 33 engaged with a pinion 34 which is devised so as to be rotated by a shaft 35 actuated by an appropriate driving means.

In the employment of such an apparatus as mentioned above, a material "a" is supplied through the duct 22 into the distributing chamber 20 inside the inner cylinder 21, and carried through the inside of the distributing chamber 20 by the screw feeder 24, from the end adjacent to the duct 22 toward the opposite end thereof. As the material "a" is carried by the screw feeder 24 is more remote from the side of the duct 22, its pressure is successively more elevated inside the distributing chamber 20, and with the increase of the pressure, the material is distributed on the belt 3 through the respective distributing nozzles 23 and 35, at almost uniform linear velocities.

In this case, if the viscosity of the material is low, the number of revolutions of the screw feeder 24 is increased by the variable speed motor 27, while if the viscosity is high, the number is decreased, to afford linear velocities suitable to the physical properties of the material being distributed. Further, what extent of linear velocity is suitable for what material is predetermined taking temperature, degree of vacuum, etc. into account.

Next, if control of the amount of the material distributed is desired, the outer cylinder 32 is rotated by the pinion 34 engaged with the toothed ring 33 fixed onto the outer cylinder, whereby the distributing nozzles 35 of the outer cylinder 32 are displaced relative to the distributing nozzles 23 of the inner cylinder 21, to make it possible to reduce the aperture size of the nozzles and hence the amount of the material to be distributed. On the other hand, if an increase of the amount is desired, the nozzles 35 may be to the contrary displaced so as to be in alignment with the nozzles 23. Further, if stopping of the material supply is desired, the nozzles 35 are moved out of alignment with the nozzles 23. At the time of stopping, supply by means of the feeder 24, of course, is also stopped, and it goes without saying that such a related actuation may be made optionally by means of a conventional control mechanism.

FIG. 9 shows a velocity distribution of the material "a" distributed through the respective nozzles 23 and 35 in the above-mentioned manner, from which distribution it will be apparent that the material "a" distributed through the respective nozzles 23 and 35 is distributed at an equal linear velocity.

Although a particularly preferred embodiment of the present invention have been disclosed herein above for the purpose of illustration, it will be understood that variations or modifications thereof which lie within the scope of the invention as defined by the appended claims are fully contemplated.

What is claimed is:

1. An apparatus provided above a movable belt inside a vacuum drying chamber and adapted for supplying material onto the belt, which comprises:

an inner cylinder equipped with a material-supplying duct for supplying material into said inner cylinder adjacent to one end thereof, a distributing chamber formed inside said inner cylinder and communicating with said duct and a plurality of first distributing nozzles on the lower part of said inner cylinder and communicating with said distributing chamber for discharging said material from said distributing chamber;

an outer cylinder sleeved on and mounted for rotation relative to said inner cylinder, said outer cylinder having a plurality of second distributing nozzles provided at positions corresponding to the positions of said first distributing nozzles on said inner cylinder, said second distributing nozzles on said outer cylinder being adapted for cooperative registration with said first distributing nozzles on said inner cylinder to regulate the amount of material discharged from said distributing chamber;

a rotatable screw feeder inside said distributing chamber of said inner cylinder for feeding said material along said distributing chamber so that said material can be discharged through said first distributing nozzles on said inner cylinder at substantially equal linear velocities; and a driving mechanism for rotating said outer cylinder relative to said inner cylinder whereby to regulate the amount of material discharged from said distributing chamber.

2. An apparatus according to claim 1 including a variable speed motor for driving said screw feeder.

3. An apparatus according to claim 1 or claim 2 wherein said driving mechanism is composed of a toothed ring provided on the outer periphery of said outer cylinder and a pinion engaged therewith.

4. An apparatus provided above a movable belt inside a vacuum chamber and adapted for supplying material onto the belt, which comprises:

an elongated inner cylinder having a longitudinally extending, elongated, internal, distributing chamber therein, and a plurality of longitudinally spaced-apart distributing orifices along the lower side of said inner cylinder and communicating with said distributing chamber for discharging a plurality of separate streams of material from said internal distributing chamber;

means for supplying said material to said internal distributing chamber;

a rotatable screw feeder disposed inside said distributing chamber and extending longitudinally therein and adapted for feeding said material lengthwise in said distributing chamber so that said streams of said material can be discharged through said distributing orifices at substantially equal linear velocities; and an elongated outer cylinder coaxial with said inner cylinder and rotatably sleeved on the exterior of said inner cylinder for arcuate movement relative thereto about the longitudinal axis thereof, said outer cylinder having a plurality of longitudinally spaced-apart distributing openings disposed for variable cooperative registry with said distributing orifices of said inner cylinder and adapted to be selectively and reversibly moved from a first terminal position in which said distributing orifices are completely open, through positions in which said distributing orifices are partially open, to a second terminal position in which said distributing orifices are completely blocked, in response to arcuate movement of said outer cylinder relative to said inner cylinder.

5. An apparatus provided above a movable belt inside a vacuum chamber and adapted for supplying material onto the belt, which comprises:

a horizontal, elongated, tubular, inner cylinder having a longitudinally extending, elongated, internal, distributing chamber therein, said inner cylinder having a longitudinally extending row of distributing orifices along the lower side thereof and located directly above said belt, said distributing orifices being of substantially the same size and being spaced-apart from each other substantially equal distances, said distributing orifices communicating with said distributing chamber and being adapted for discharging a plurality of streams containing substantially equal amounts of said material from said distributing chamber;

a conduit for supplying said material to said internal distributing chamber adjacent to one longitudinal end thereof;

a rotatable screw feeder disposed inside said internal distributing chamber and extending longitudinally therein from adjacent to said one longitudinal end thereof to adjacent to the other longitudinal end thereof and adapted for feeding said material lengthwise in said distributing chamber so that said streams of said material can be discharged through said distributing orifices at substantially equal linear velocities; and an elongated, outer cylinder coaxial with said inner cylinder and rotatably sleeved on the exterior of said inner cylinder for arcuate movement relative thereto about the longitudinal axis thereof, the interior surface of said outer cylinder being in close sliding contact with the exterior surface of said inner cylinder, said outer cylinder having a longitudinally extending row of distributing openings which are of substantially the same size and which are spaced-apart from each other substantially the same distances as said distributing orifices, each distributing opening being circumferentially aligned with one of said distributing orifices, said distributing openings being movable circumferentially, by arcuate movement of said outer cylinder relative to said inner cylinder, into and out of radial alignment with said distributing orifices to regulate the amount of or stop the flow of said material from said distributing chamber onto said belt.

* * * * *